United States Patent [19]

Lambly et al.

[11] 3,957,308

[45] May 18, 1976

[54] METHOD OF REMOVING TAR SANDS FROM SUBTERRANEAN FORMATIONS

[76] Inventors: Charles A. R. Lambly, 32 Essex Court, Alamo, Calif. 94507; Charles T. Draney, 275 Pinehill Road, Hillsborough, Calif. 94010

[22] Filed: Nov. 8, 1974

[21] Appl. No.: 522,197

[52] U.S. Cl. ..... 299/14; 299/17

[51] Int. Cl.[2] ..... E21C 41/10

[58] Field of Search ..... 299/3, 4, 5, 14, 17; 175/67; 166/272, 303

[56] References Cited

UNITED STATES PATENTS

| | | | |
|---|---|---|---|
| 950,363 | 2/1910 | Blake | 299/17 X |
| 1,612,611 | 12/1926 | Claytor | 299/17 X |
| 3,050,289 | 8/1962 | Gerner | 299/17 X |
| 3,279,538 | 10/1966 | Doscher | 166/272 X |
| 3,739,851 | 6/1973 | Beard | 166/272 X |
| 3,858,654 | 1/1975 | Walker | 166/272 X |

*Primary Examiner*—Stephen J. Novosad
*Assistant Examiner*—George A. Suckfield

[57] ABSTRACT

Hydraulic mining of tar sands in a formation wherein water is introduced into a plurality of spaced cavities in the bottom of a tar sands formation and above a number of tunnels communicating with respective cavities by openings. In one, embodiment of the method, water is sprayed onto exposed tar sands surfaces in the cavity and further creates a moist atmosphere in those regions of the cavity where the water is not directly sprayed on the surfaces. The moist atmosphere can be in the form of suspended water droplets or can be saturated water vapor at a temperature above the ambient temperature of the tar sands or a combination of both. The water on the exposed surfaces penetrates the formation along paths of preferential wetability, causing adjacent portions of the formation to separate and break loose from the formation itself in a direction in which the portions are free to expand. This separation enlarges each cavity and the separated tar sands portions eventually disintegrate and become loosened tar sands by the continued presence of the water spray and the moist atmosphere. Heat can be introduced in the form of steam or by heating the incoming water, and the heat accelerates the separation of the formation and the disintegration of the tar sands portions. The disintegrated tar sands are slurried in water with the aid of one or more water jets or by other suitable mechanical action, and are removed as a slurry by gravity flow from each cavity.

20 Claims, 4 Drawing Figures

METHOD OF REMOVING TAR SANDS FROM SUBTERRANEAN FORMATIONS

This invention relates to improvements in the hydraulic and solution mining and removal of subterranean tar sands deposits capable of being disintegrated by water, steam, or water and additives and, more particularly, to the controlled removal of tar sands from a region below the surface of the earth.

BACKGROUND OF THE INVENTION

A substantial portion of the world's tar sands deposits are situated under a thick overburden which is a layer or rock and soil. Because of a presence of overburden, strip mining of most tar sands becomes extremely costly and essentially prohibitive. Thus, a need has arisen to provide an economical method of mining tar sands located in formations below a thick overburden so that the cost of the energy-providing and other products obtainable from the tar sands will be within reasonable limits compared with corresponding costs of other such products.

SUMMARY OF THE INVENTION

It has been determined that tar sands from a subterranean formation can more effectively be extracted if exposed tar sands surfaces of adjacent cavities formed in a tar sands formation are continuously wetted so that water can penetrate the tar sands and cause the latter to spall and break off in blocks. This action is believed to be caused by water penetrating the formation through capillary action along paths of preferential wetability, causing adjacent portions of the formation to be essentially lubricated so that the binding forces between them diminish to the point where some of the tar sands portions separate from the formation and fall as blocks and loose tar sands into and toward the bottoms of the corresponding cavities while the remaining formation is left temporarily intact and presents new surfaces to be wetted to effect further spalling and so on. This action can be accelerated by the presence of heat, such as results from the introduction of hot water or steam.

The present invention is directed to a method of mining tar sands based upon the above determinations, and the method is preferably carried out by the performance of the following steps:

1. Forming a tunnel or series of tunnels in the rock formation underlying the tar sands formation or near the bottom of the tar sands formation;
2. Forming openings extending upwardly from the tunnel or tunnels at a plurality of locations and entering the tar sands and thus initiating the formation of a cavity in the tar sands at each such location;
3. Wetting the exposed tar sands surfaces in each cavity. This can be done by directing a stream of water against the exposed tar sands surfaces or by spraying water into each cavity in a manner such that the water will create and maintain a moist atmosphere. The moisture in the moist atmosphere may include suspended droplets of water. In the alternative, the moist atmosphere may be saturated with respect to water at an elevated temperature relative to the ambient temperature of the tar sands so that condensation will occur on the surfaces of the tar sands. In still another embodiment of the method, partial or total filling of each cavity with water can be effected to wet the exposed tar sands surfaces;
4. Maintaining wetting so that the water on the exposed tar sands surfaces in each cavity permeates the surface of the formation, including blocks of tar sands resulting from spalling, along paths of preferential wetability and/or by capillary action, so that adjacent portions of the formation will be lubricated and certain of the portions will spall and slough from the formation as blocks and chunks and gravitate toward the bottom of the corresponding cavity;
5. As the blocks or chunks of tar sands from spalling and sloughing rest in each cavity, disintegration of the blocks and chunks is accomplished by the wetting action of the water in the cavity;
6. Converting the disintegrated tar sands to slurry form by streams of water introduced under pressure or by other mechanical action. While the water introduced to cause spalling and sloughing may be introduced separately from that introduced for slurrying, water for both purposes may be introduced as a single stream;
7. Directing the slurried tar sands out of the cavities by gravity flow through pipes to pumps in the tunnels and thence to a processing plant;
8. Maintaining constant wetting of all exposed tar sands surfaces to continue the spalling, sloughing, disintegrating, slurrying, and slurry-removing steps to cause each cavity to continue to enlarge so that, as each cavity grows in size, the ability of the roof thereof and of the walls between adjacent cavities to support the weight of the remaining tar sands formation and that of the overburden is diminished, and deformations of the remaining tar sands formation will, therefore, occur in the following ways:
   a. Gradual subsidence through plastic flow of the walls into adjacent cavities; and
   b. Collapsing of the roof when its span between supporting walls becomes too great to enable it to withstand its own weight and the weight of the overburden. The tar sands masses which enter each cavity as a result of a) and b) are subjected to the wetting and mechanical action of the water such that disintegration and slurrying occurs in the same manner as that for the tar sands blocks loosened by spalling and sloughing, and thus becomes part of the slurry formed in and flowing from the cavity;
9. The foregoing mining procedure in any given cavity continues until all, or essentially all, of the tar sands have been removed, and is discontinued at such time as the overburden reaches the bottom of the cavity. By thus progressively mining out adjacent rows of cavities, the tar sands within a subterranean formation can be progressively and systematically removed and, while being so removed, the overburden will be caused to subside in a controlled and orderly manner.

The primary object of this invention is to provide an improved method for removing tar sands from a subterranean formation wherein the method includes the step of continuously wetting all exposed tar sands surfaces in a plurality of cavities so that water permeates the tar sands formation along paths of preferential wetability and/or capillary action, causing continuous spalling and sloughing of the formation and progressive separation of the formation into smaller and smaller portions until the tar sands are disintegrated and then slurried with water for removal from each cavity by gravity flow.

Another object of the present invention is to provide a method of the type described wherein the water can be sprayed in the cavities to wet the exposed surfaces directly and the sprayed water operates to present a moist atmosphere to wet the exposed surfaces not directly reachable by the water spray.

Other objects of this invention will become apparent as the following specification progresses, reference being had to the accompanying drawings for an illustration of the apparatus and the sequence of steps for carrying out the method.

Figures 2, 2A:
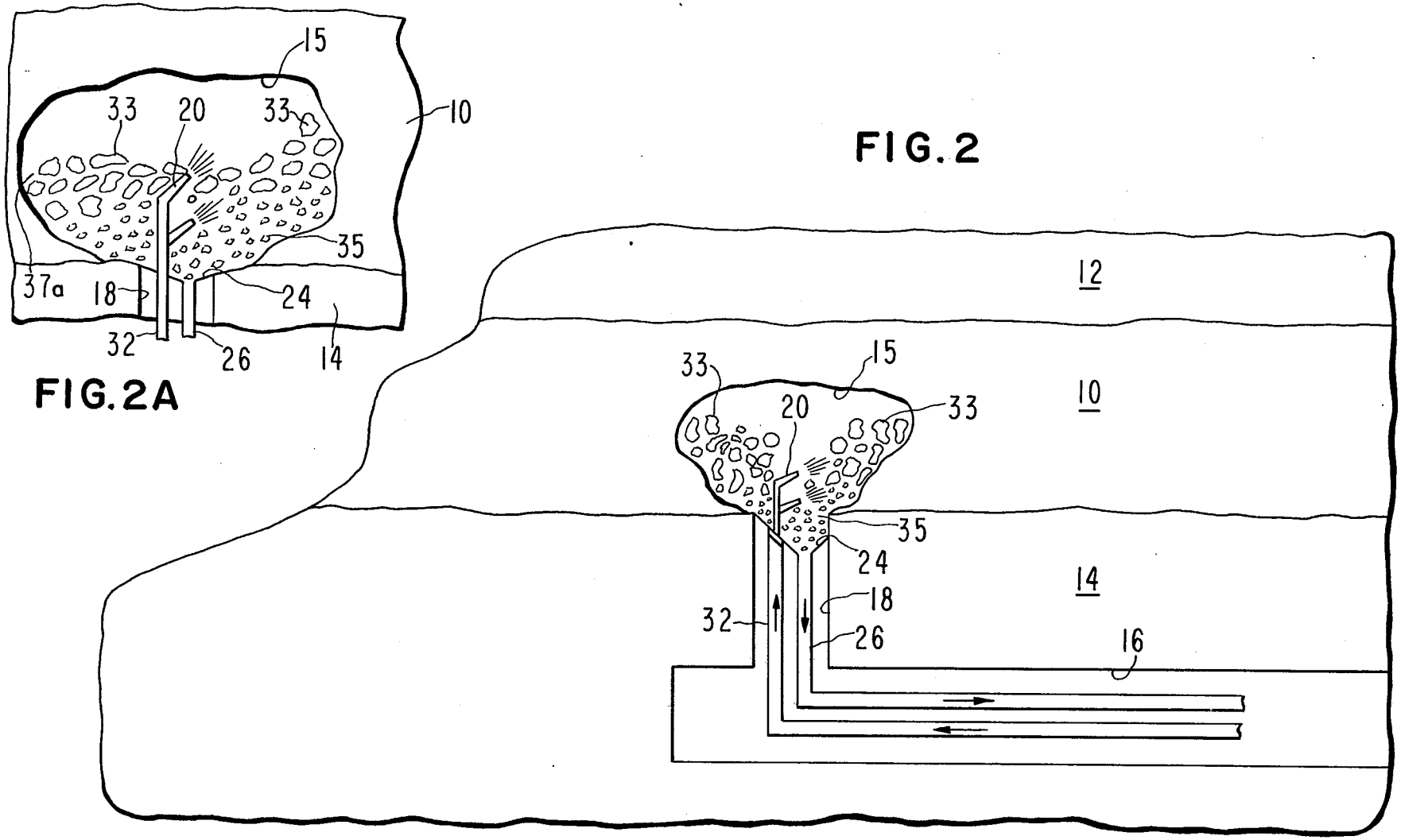
FIG. 2 is a view similar to FIG. 1 but illustrating an intermediate step in the operation according to the present method.
Figure 3:
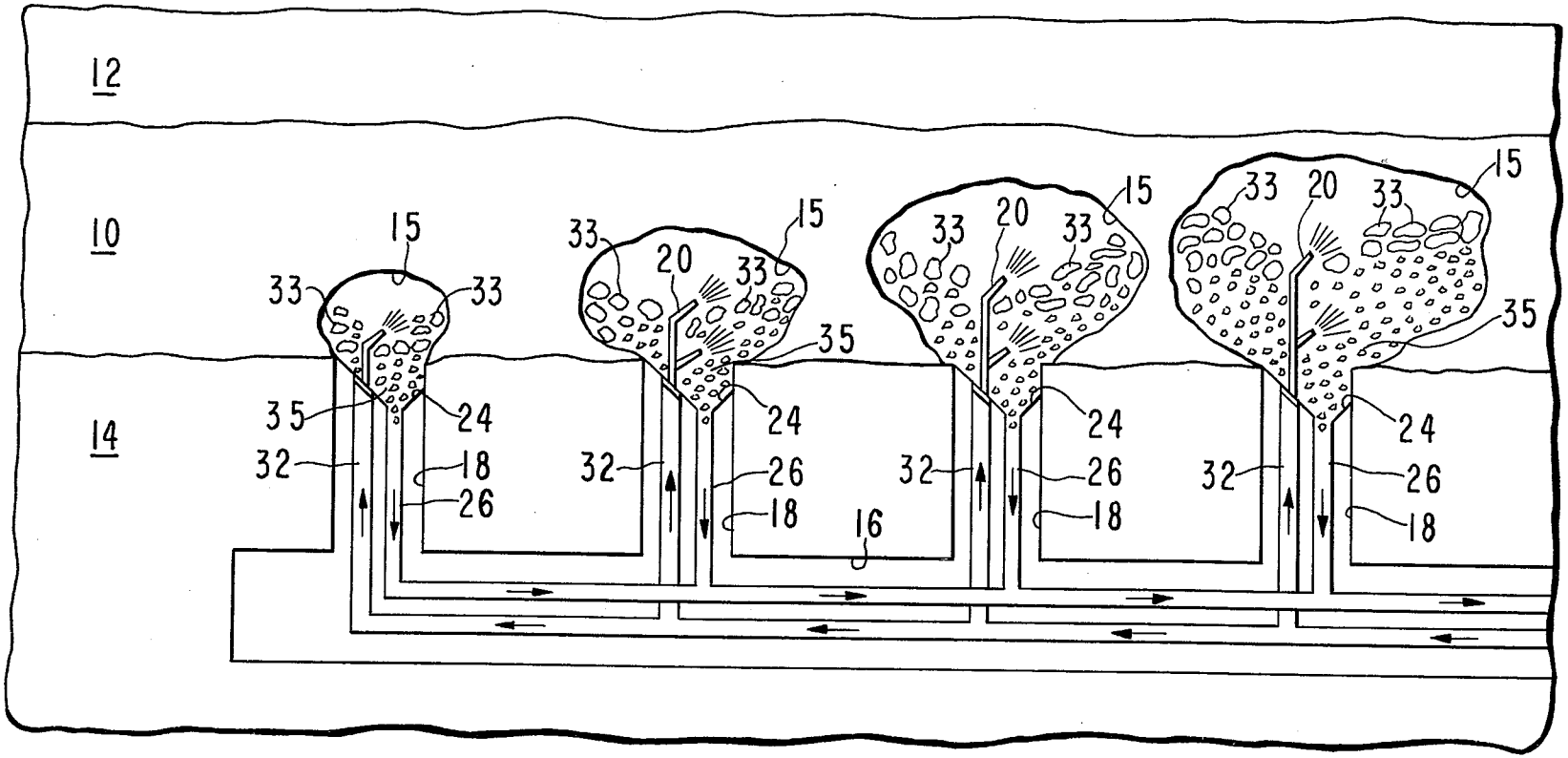
Figure 4:
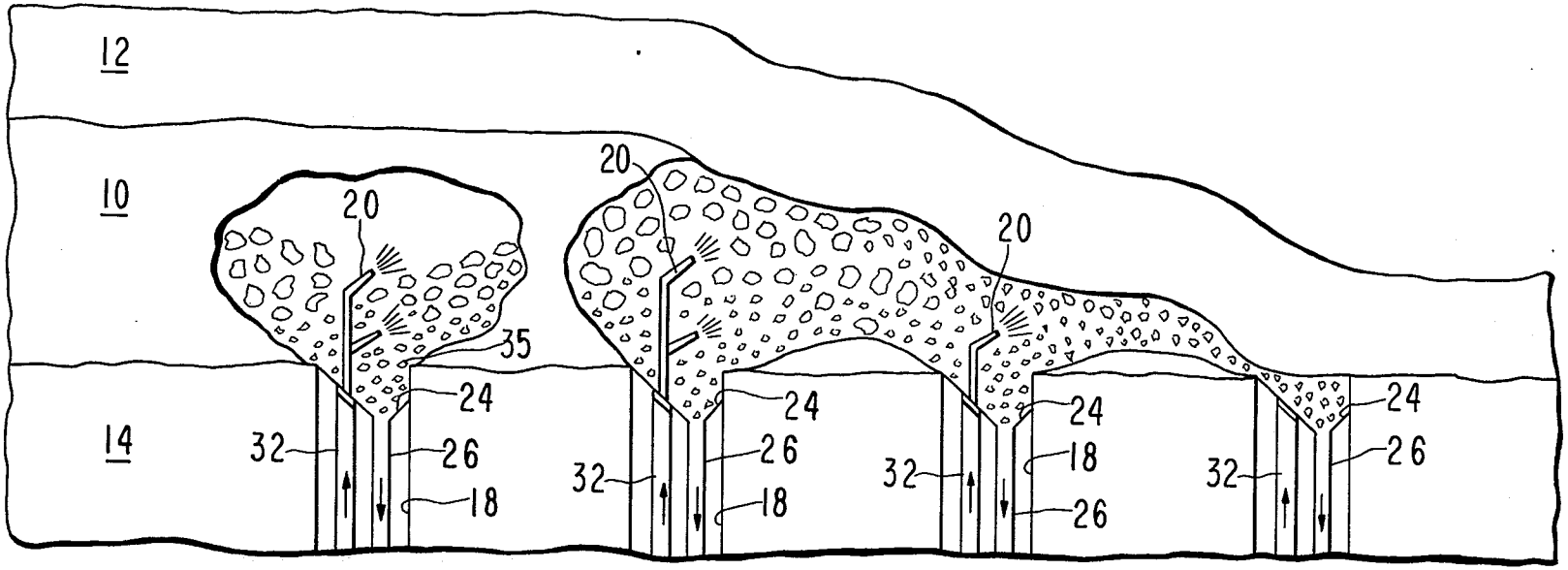

FIG. 2*a* is an enlarged, fragmentary view of the cavity in the tar sands after portions thereof have broken loose in the form of blocks and chunks and rest on a disintegrated tar sands mass;

FIG. 3 is a view similar to FIG. 2 but showing progressive removal of tar sands from several horizontally displaced locations in the tar sands layer; and FIG. 4 is a view similar to FIG. 3 but illustrating the way in which an overburden above the tar sands has progressively subsided in locations where the tar sands have been removed in accordance with the present method.

Figure 1:
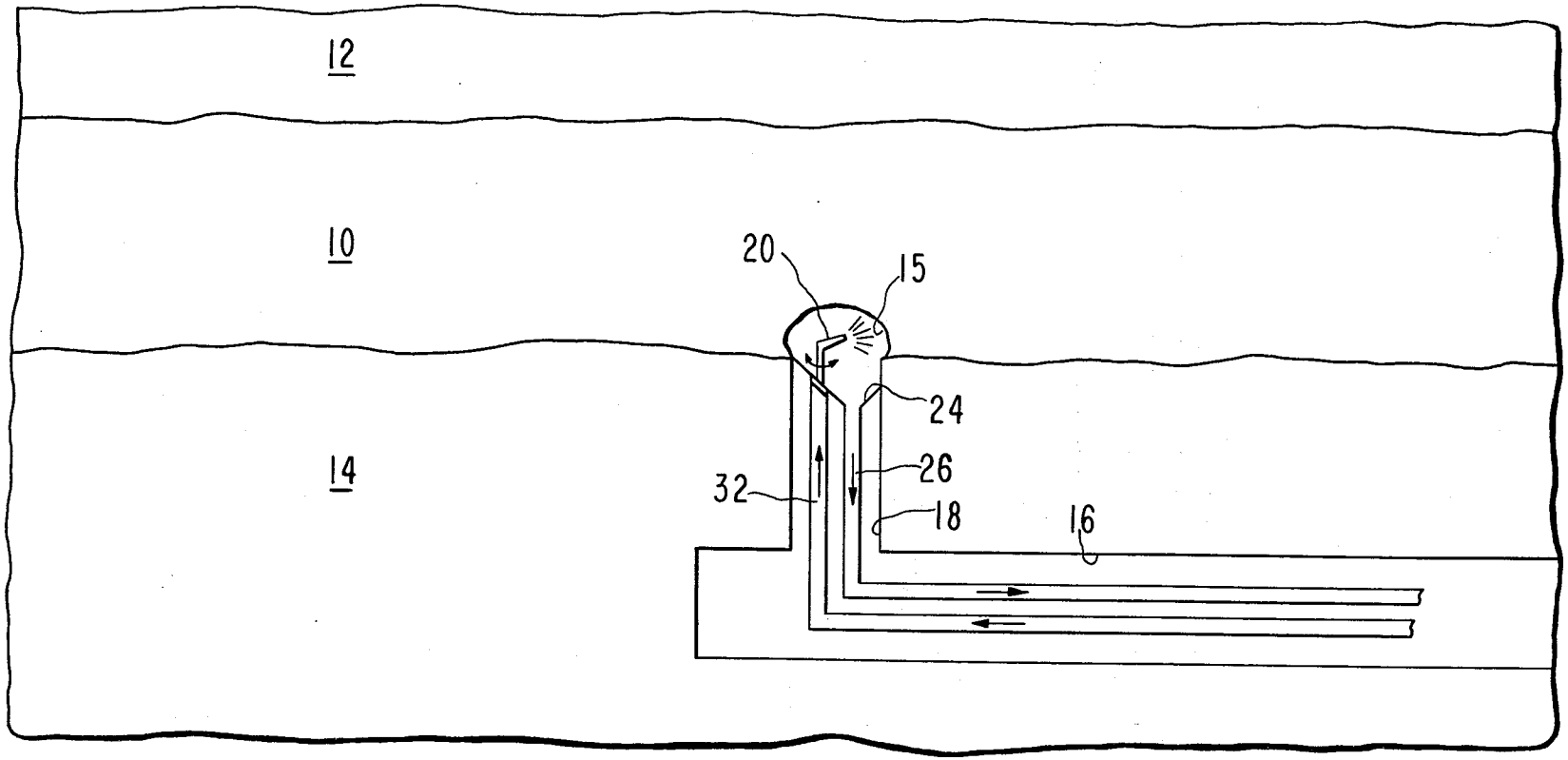
FIG. 1 is a schematic view of apparatus for carrying out the method of the present invention, showing its location in a lower cavity of a layer of tar sands at the beginning of a hydraulic mining operation according to the method.

The method of this invention relates to the removal of tar sands from a subterranean layer 10 located below an overburden 12 and above an underlying formation 14 through which a plurality of generally parallel tunnels 16 can be formed in any suitable manner. Each tunnel can be horizontal or inclined as desired or as deemed necessary. A group of upwardly extending openings or passages 18 are formed from each tunnel 16 through formation layer 14 and only slightly into tar sands layer 10 to form cavities 15 therein, only one of such cavities being shown in FIGS. 1 and 2 merely to simplify discussion. A number of cavities are shown in FIGS. 3 and 4. For each such opening 18, one or more nozzles 20 are placed in the corresponding cavity in an operative position to spray or otherwise deliver water or steam or water and steam into the cavity. Each nozzle can either be stationary or can be controlled for movement in a predetermined direction or directions. The purpose of delivering water or steam or water and steam into each cavity is to continuously wet all exposed tar sands surfaces therein. This is done by direct spraying where possible. In those regions of each cavity not directly reachable by the water spray, a moist atmosphere will be present due to the incoming water or steam or water and steam. This moist atmosphere wets all exposed tar sands surfaces which it contacts. This moist atmosphere can be composed of one or both of the following types:

1. Suspended water droplets in the atmosphere regardless of temperature of the same;

2. Saturated water vapor at a temperature above the ambient tar sands temperature so as to cause condensation on exposed tar sands surfaces when the vapor contacts the same.

For each opening 18, a drainage trough 24 is provided and is placed at the junction between layers 10 and 14 to receive a slurry formed of water and disintegrated or loosened tar sands to permit the same to be carried off by gravity flow through a tube 26 extending downwardly in opening 18, laterally through tunnel 16 and outwardly to a processing station (not shown), to separate the tar, the sand and the water from each other.

Each water nozzle 20 is fed by a tube 32 which also extends from a source of water (not shown) under pressure through the tunnel 16 and opening 18 to the nozzle. Typically, the temperature of the water is maintained at or above the ambient temperature of the tar sands formation of layer 10.

Water is used to slurry disintegrated tar sands in each cavity 15. At least part of the water may be introduced separately from the water introduced for wetting and under sufficient pressure to provide the mechanical action needed to assure the creation of a proper slurry. The nozzle used for slurrying could be, under the proper conditions, the nozzle which provides water for wetting the exposed tar sands surfaces.

Each nozzle 20 may be stationary or may be movable so as to discharge water in a plurality of directions which may include, but need not be limited to, horizontal and vertical planes. Each nozzle also is preferably slightly inclined to permit the spraying of the maximum exposed area of the corresponding cavity. The water delivery from the water jet can be a high-speed or low-speed delivery and the volume rate of flow of water can be varied as desired or deemed necessary. The greater the quantity of loosened tar sands in each cavity, the greater is the rate of introduction of water to accomplish continued walls disintegration and slurrying between adjacent cavities 15. The criteria for the flow of water into each cavity 15 are as follows:

1. It must be of sufficient volume to sustain wetting of the exposed tar sands surfaces such as by direct spraying, maintaining a moist atmosphere, or partial or total flooding of each cavity;
2. It must be of sufficient volume to form a slurry with disintegrated tar sands at a rate commensurate with the rate at which the tar sands become disintegrated.

The wetting of exposed tar sands surfaces allows water to seep into or permeate the tar sands formation and lubricate the interfaces or junctions between adjacent tar sands portions, causing the binding forces therebetween to be diminished to such an extent that the tar sands portions progressively separate from the formation and fall, i.e., spall or slough, into the cavity. The permeation of the water into the formation is believed to be by capillary action or to occur along paths of preferential wetability. The presence of heat accelerates the spalling and sloughing so that the warmer the water, the greater the rate at which spalling and sloughing occurs. Either steam or heat water, or both, are the acceptable means for providing the heat to a cavity.

As tar sands portions spall and slough, they drop as blocks or chunks 33 (FIG. 2*a*) and such blocks or chunks present newly exposed surfaces, all of which are wetted as described above. These blocks or chunks themselves then absorb water by preferential wetability or by capillary action as described above and they eventually break up into smaller masses and so on until the tar sands become sufficiently loosened or disintegrated to permit them to form a slurry with water in the cavity.

The slurry gravitates from each cavity into the corresponding trough 24 and tube 26. The mass of disintegrated tar sands is denoted by the numeral 35 in FIG. 2*a* and is located in the corresponding tar sands cavity 15 below a number of blocks or chunks 33 in surrounding relationship to the corresponding water nozzle 20.

Water nozzle 20 continues to deliver water to the corresponding cavity as blocks or chunks 33 fall and as the wetting action further disintegrates the tar sands. The moist atmosphere in each cavity 15 permeates all spaces in the cavity, including those spaces between blocks or chunks 33. Space 37*a* (FIG. 2*a*) is such a space. Thus, water is assured of contacting substantially all exposed surfaces of the tar sands.

In carrying out the method of this invention, one embodiment thereof utilizes preferably warm or hot water directed through tube 32 to water nozzle 20 of each cavity 15, respectively, the water being at a temperature above the ambient temperature of the tar sands. Typically, this ambient temperature is about 40°F. and the water is heated in the range of 50°F. to above 212°F. The hotter the water, the more effective is the removal of the tar sands by the present method.

The water issuing from water nozzles 20 is directed into respective cavities 15 and sprayed onto exposed tar sands surfaces and the water also creates and maintains the above-mentioned moist atmosphere therein. The water from the spray or moist atmosphere wets all exposed surfaces and penetrates the same during a finite period of time. This penetration is by capillary action or along paths of preferential wetability. At the end of an elapsed period of time, dependent upon the temperature of the water and the areas of exposed surfaces, the water will have penetrated at least to a certain depth into the tar sands to cause portions of the same to separate from layer 10 in blocks or chunks due to the lubricating effects of the water. Ultimately, the tar sands will become substantially totally disintegrated and will form a slurry with the water. This slurry is collected in trough 24 and carried out of the cavity in tar sands layer 10 by way of tube 26 to a processing station by means of a suitable pump (not shown).

As blocks or chunks 33 fall into the cavity as shown in FIG. 2, the water delivery continues as a spray and as a moist atmosphere in each cavity and immediately contacts and wets all newly exposed tar sands surfaces, including those of said blocks and chunks, as they are formed. The water continues to flow along paths of preferential wetability or by capillary action into the interior of the blocks or chunks having the new surfaces, eventually causing such blocks or chunks to spall and slough into smaller blocks or chunks or to be substantially completely disintegrated to form loosened tar sands masses which can form slurries with the water being delivered into the cavities.

The water delivered to each water nozzle 20 can be provided with additives to enhance the wetting or the permeation of water into the tar sands.

FIG. 3 further illustrates the progressive removal of tar sands from layer 10. Each cavity of FIG. 3 is one of a number of cavities in a respective row which is perpendicular to tunnel 16. Typically, the cavities in each of said rows are simultaneously mined at essentially the same rate. The mining of the cavities of the right hand row of FIG. 3 is typically commenced before the mining of the cavities of the next adjacent row to the left in FIG. 3. Typically, also, at any given time, mining of the cavities of a number of such rows are simultaneously carried on and are at different stages of completion. The mining of each of such rows of cavities is substantially completed before the completion of the mining of the cavities of the next adjacent row. This results in a systematically controlled mining-out of the tar sands and subsidence of the overburden.

As cavities 15 progressively enlarge, the walls between adjacent cavities become smaller and smaller in cross section. Eventually, the pressure of the weight of the overlying tar sands and overburden causes these walls to flow laterally into the cavities, thereby contributing to the subsidence of the formation and of the overburden. Also, as the aforesaid walls become smaller in cross section, the roof span of each cavity becomes correspondingly greater until it is no longer capable of supporting the overlying formation and the overburden. At this point, collapse of the roof span occurs, causing the formation and overburden to further subside. The tar sands that flow into the cavities from such walls and drop into the cavities from the roof spans mentioned above, are caused to disintegrate and thereupon are removed in slurry form as described above.

Several different small scale tests were conducted in Sept. and Oct. of 1974 to determine the effect of the wetting of tar sands. These tests, while not being conducted on a full scale basis as disclosed above, did conform that wetting of tar sands surfaces for a time sufficient to permit water to permeate the tar sands did cause them to spall and to break up into smaller pieces and eventually into loosened tar sands. The results of these tests are available in two documents in the library of Bechtel Corporation, 50 Beale Street, San Francisco, Calif. 94119. These documents are entitled as follows:

1. Lambly Mining Scheme, Series Test No. 1 in Tar Sands, Mildred Lake, Alberta, Canada, Sept. 28, 1974;
2. Lamply Mining Scheme, Series Test No. 2, Edmonton, Alberta, Canada, Oct. 16, 1974.

We claim:

1. A method of removing tar sands from a subterranean layer located below an overburden and above an underlying formation comprising: forming a plurality of tunnels in said underlying formation; forming a number of spaced openings from each tunnel to said layer and partially into the layer to present a number of cavities in the bottom of a preselected region of the layer; wetting the exposed surfaces of the tar sands in each cavity for a time sufficient for the water to permeate into said layer, whereby the adjacent portions of the layer will become lubricated relative to each other and will break off from the layer and separate from each other and fall into the cavity to thereby enlarge the latter and to present newly exposed tar sands surfaces; wetting said newly exposed tar sands surfaces for a time sufficient to permit water to penetrate the broken off portions and the layer, whereby said broken off portions will separate into smaller masses and additional tar sands portions will break off from said layer and separate from each other and fall into the cavity to further enlarge the latter and to form additional newly exposed tar sands surfaces; wetting the exposed surfaces of said smaller masses to cause the same to disintegrate to form loosened tar sands; mixing said loosened tar sands with water to form a slurry; removing the slurry by gravity flow from said cavity; and repeating the wetting, mixing and removing steps until substantially all of the tar sands in said region have been disintegrated and removed in the form of slurries.

2. A method as set forth in claim 1, wherein the water for the wetting and mixing steps is introduced into each cavity as a single stream.

3. A method as set forth in claim 1, wherein at least one of the wetting steps includes delivering water in the liquid phase into each cavity.

4. A method as set forth in claim 1, wherein at least one of the wetting steps includes delivering water in the vapor phase into each cavity.

5. A method as set forth in claim 1, wherein at least one of the wetting steps includes delivering water in mixed liquid and vapor phases into each cavity.

6. A method as set forth in claim 1, wherein at least one of the wetting steps includes spraying water into each cavity.

7. A method as set forth in claim 1, wherein at least one of the wetting steps includes directing steam into each cavity.

8. A method as set forth in claim 1, wherein at least one of the wetting steps includes partially filling each cavity with water.

9. A method as set forth in claim 1, wherein at least one of the wetting steps includes substantially totally filling each cavity with water.

10. A method as set forth in claim 1, wherein each wetting step includes maintaining a moist atmosphere in each cavity in surface-wetting contact with exposed tar sands surfaces adjacent thereto.

11. A method as set forth in claim 1, wherein the moisture in the moist atmosphere includes suspended water droplets.

12. A method as set forth in claim 1, wherein the moist atmosphere is saturated with respect to water at a temperature above the ambient temperature of the tar sands formation to effect condensation of the water when the atmosphere contacts exposed tar sands surfaces.

13. A method as set forth in claim 1, wherein is included the step of providing additives to the water before the same is delivered to the cavities with the additives being operable to enhance the penetration of the water into the layer and the broken off material.

14. A method of mining a subterranean tar sands formation comprising: forming a plurality of tunnels below said tar sands formation and an opening for each of a number of cavities in the formation, respectively, each opening extending from a corresponding tunnel to a respective cavity; directing a flow of water along paths extending through certain of said tunnels and said openings and wetting the exposed surfaces of the tar sands formation for a time sufficient to permit water to permeate the tar sands formations, causing it to spall and the spalled material to fall into the corresponding cavities, whereby said cavities will be enlarged to present newly exposed tar sands surfaces; wetting the newly exposed surfaces of the formation and of the spalled material, whereby water will penetrate said newly exposed surfaces to cause further spalling; wetting the spalled material until it has substantially disintegrated into loosened tar sands; and removing the loosened tar sands from each cavity in the form of a slurry by gravity flow during the wetting steps.

15. A method as set forth in claim 14, wherein said removing step includes allowing the slurry from each cavity to gravitate through the respective opening to the corresponding tunnel.

16. A method as set forth in claim 14, wherein at least one of the wetting steps includes delivering water in the liquid phase into each cavity.

17. A method as set forth in claim 14, wherein at least one of the wetting steps includes delivering water in the vapor phase into each cavity.

18. A method of mining a subterranean tar sands formation comprising: wetting the exposed surfaces of the tar sands formation for a time sufficient to permit water to permeate the tar sands formations, causing it to spall and the spalled material to fall into the cavities, whereby the cavities will be enlarged to present newly exposed tar sands surfaces; wetting the newly exposed surfaces of the formation and of the spalled material, whereby water will penetrate said newly exposed surfaces to cause further spalling; wetting the spalled material until it has substantially disintegrated into loosened tar sands; and removing the loosened tar sands from each cavity in the form of a slurry by gravity flow during the wetting steps, at least one of said wetting steps including spraying water into each cavity.

19. A method of mining a subterranean tar sands formation comprising: wetting the exposed surfaces of the tar sands formation for a time sufficient to permit water to permeate the tar sands formations, causing it to spall and the spalled material to fall into the cavities, whereby the cavities will be enlarged to present newly exposed tar sands surfaces; wetting the newly exposed surfaces of the formation and of the spalled material, whereby water will penetrate said newly exposed surfaces to cause further spalling; wetting the spalled material until it has substantially disintegrated into loosened tar sands; and removing the loosened tar sands from each cavity in the form of a slurry by gravity flow during the wetting steps, at least one of the wetting steps including partially filling each cavity with water.

20. A method of mining a subterranean tar sands formation comprising: wetting the exposed surfaces of the tar sands formation for a time sufficient to permit water to permeate the tar sands formations, causing it to spall and the spalled material to fall into the cavities, whereby the cavities will be enlarged to present newly exposed tar sands surfaces; wetting the newly exposed surfaces of the formation and of the spalled material, whereby water will penetrate said newly exposed surfaces to cause further spalling; wetting the spalled material until it has substantially disintegrated into loosened tar sands; and removing the loosened tar sands from each cavity in the form of a slurry by gravity flow during the wetting steps, at least one of the wetting steps including substantially totally filling each cavity with water.

* * * * *

UNITED STATES PATENT OFFICE

CERTIFICATE OF CORRECTION

PATENT NO. : 3,957,308

DATED : May 18, 1976

INVENTOR(S) : Charles A. R. Lambly and Charles T. Draney

It is certified that error appears in the above-identified patent and that said Letters Patent are hereby corrected as shown below:

After the listing of the inventors on the title page of the patent, insert the following:

"Assignee: Bechtel International Corporation
San Francisco, California

Signed and Sealed this

Thirtieth Day of November 1976

[SEAL]

*Attest:*

RUTH C. MASON
*Attesting Officer*

C. MARSHALL DANN
*Commissioner of Patents and Trademarks*